US006820839B2

(12) United States Patent
Weis

(10) Patent No.: US 6,820,839 B2
(45) Date of Patent: Nov. 23, 2004

(54) ANGLE BAR ASSEMBLY METHOD FOR DEVIATING A MATERIAL WEB

(75) Inventor: Anton Weis, Lorsch (DE)

(73) Assignee: Koenig & Bauer Aktiengesellschaft, Wurzburg (DE)

( * ) Notice: Subject to any disclaimer, the term of this patent is extended or adjusted under 35 U.S.C. 154(b) by 121 days.

(21) Appl. No.: 10/221,188

(22) PCT Filed: Mar. 16, 2001

(86) PCT No.: PCT/DE01/01015

§ 371 (c)(1),
(2), (4) Date: Sep. 23, 2002

(87) PCT Pub. No.: WO01/70608

PCT Pub. Date: Sep. 27, 2001

(65) Prior Publication Data

US 2003/0075640 A1 Apr. 24, 2003

(30) Foreign Application Priority Data

Mar. 22, 2000 (DE) ..... 100 14 257
May 11, 2000 (DE) ..... 100 22 964

(51) Int. Cl.[7] ..... B65H 23/32
(52) U.S. Cl. ..... 242/615.21
(58) Field of Search ..... 242/615.21

(56) References Cited

U.S. PATENT DOCUMENTS 3,339,817 A * 9/1967 French ..... 226/100
3,369,276 A * 2/1968 Kalwaites ..... 19/65 T
3,434,639 A 3/1969 Cowles
3,734,487 A 5/1973 Treff
3,809,303 A 5/1974 Brunner
4,043,495 A * 8/1977 Sander ..... 242/615.12
4,154,386 A * 5/1979 Kawada ..... 226/91
5,016,801 A * 5/1991 Gilat et al. ..... 242/615.21
5,100,117 A 3/1992 Hajek et al.
5,108,022 A 4/1992 Birkmair et al.
5,273,201 A 12/1993 Hambrecht
5,520,317 A * 5/1996 Eckert et al. ..... 242/615.12
5,568,245 A 10/1996 Ferber et al.
5,573,231 A * 11/1996 Stab ..... 270/43
6,047,922 A 4/2000 Michalik
6,325,266 B1 * 12/2001 Suzuki ..... 226/92
6,695,250 B2 * 2/2004 Michalik et al. ..... 242/615.21

FOREIGN PATENT DOCUMENTS

| | | |
|---|---|---|
| DE | 2 020 139 | 11/1970 |
| DE | 1 761 899 | 12/1971 |
| DE | 87 17 253.4 | 8/1988 |
| DE | 38 16900 C1 | 11/1989 |
| DE | 41 17 094 A1 | 12/1992 |
| DE | 196 40 978 A1 | 11/1997 |
| EP | 0 342 491 A2 | 11/1989 |
| EP | 0 697 634 A1 | 2/1996 |
| EP | 0 784 590 B1 | 4/1999 |
| EP | 1 024 101 A1 | 8/2000 |
| WO | WO 97/40985 | 11/1997 |

* cited by examiner

*Primary Examiner*—Kathy Matecki
*Assistant Examiner*—Sang Kim
(74) *Attorney, Agent, or Firm*—Jones, Tullar & Cooper, P.C.

(57) ABSTRACT

A turning bar arrangement for redirecting the path of travel of a material web utilizes at least one turning bar and at least one register roller. The web of material is caused to be enwrapped about both and extends between both to define a plane. When viewed in a direction perpendicular to this plane, the turning bar and the register roller do not overlap.

19 Claims, 3 Drawing Sheets

ANGLE BAR ASSEMBLY METHOD FOR DEVIATING A MATERIAL WEB

FIELD OF THE INVENTION

The present invention is directed to a turning bar arrangement and to a method for redirecting a web of material. The turning bar arrangement includes a turning bar and a register roller and these are useable to redirect the web of material.

BACKGROUND OF THE INVENTION

Webs of material, in particular paper webs, whose width is a multiple of the widths of the finished printed products, are generally printed in rotary printing presses. In order to produce a finished printed product from the printed web, it is necessary to cut this web into a plurality of partial webs, which plurality of partial webs are initially conducted next to each other but must eventually be placed on top of each other in order to be further processed into the finished printed product, mainly by folding the plurality of partial webs in the longitudinal and transverse directions and by transverse cutting. In the course of the transverse cutting of the partial webs of material, which have been placed on top of each other, it is important that printed pages on the individual partial webs of material are exactly aligned in phase with each other, so that all of the partial webs of material are cut at the borders of respectively two sides during transverse cutting. Register rollers, which are adjustable, are employed for this purpose. The adjustability of these register rollers makes it possible to set the length of each path of the web of material by use of the turning bar arrangement in such a way that sides which are intended to be processed into a signature, on the various webs come to rest exactly on top of each other.

An example of such a turning bar arrangement is known from U.S. Pat. No. 3,734,487. This turning bar arrangement comprises a first turning bar which can be displaced transversely in relation to the feed direction of the web of material to be redirected, as well as two register rollers and one additional register roller. The register roller can be displaced in a plane located underneath the turning bars. If it is intended to place a large number of webs of material on top of each other, a stack of four turning bar arrangements, placed on top of each other, is employed. However, a relatively small number of webs of material, which are to be placed on top of each other, is sufficient for the stack of these known turning bar arrangements to become higher than a man, which height considerably complicates the maintenance of the stack of turning bar arrangements and the draw-in of the webs of material in case of a change in orders.

An arrangement for offsetting narrow paper webs in the form of partial paper webs is known from DE 38 16 900 A1.

DE-AS 17 61 899 discloses turning bars offset in height.

U.S. Pat. No. 3,734,487 shows two turning bars arranged in the shape of a triangle. A web of material can be conducted onto a register roller from these two turning bars.

EP 0 784 590 B1 shows a turning arrangement wherein a guide roller and the turning bars have different diameters. The turning bars, which are arranged at 90° in respect to each other, have the same diameter.

SUMMARY OF THE INVENTION

The object of the present invention is directed to providing a turning bar arrangement and to providing a method for redirecting a web of material.

In accordance with the present invention, this object is attained by providing a turning bar arrangement that includes at least a first turning bar and a register roller. The web passes between the register roller and the turning bar in a plane. The first turning bar and the register roller, when viewed in a direction that is perpendicular to that plane, do not overlap. Both the turning bar and the register roller are supported at only one end. The register roller may be arranged exteriorly of the lateral frames of the printing device and its axis may be parallel to the direction of web travel in the printing machine. A second turning bar and a deflection roller may also be part of the turning bar arrangement.

The advantages which can be achieved by the present invention reside, in particular, in that it is possible to keep the structural height of the turning bar arrangement low, so that the number of turning bar arrangements which can be mounted on top of each other within a predetermined structural height is increased. Thus the number of webs of material which can be placed on top of each other in a stack of turning bar arrangements can be increased without the stack reaching to a height which would make it difficult for an operator to reach the individual turning bars of the stack for maintaining them or for drawing-in a web of material.

A section of the web extending between the first turning bar and the register roller defines a first plane which, in customary turning bar arrangements, is substantially horizontal. Since, viewed in a direction which is perpendicular to this first plane, the turning bar and the register roller do not overlap, they can be arranged to be overlapping, when viewed in a direction parallel to this plane, so that the structural height can be reduced.

A particularly effective use of the available structural volume results when the first turning bar and the register roller are arranged on the same side of this first plane.

If the register roller has a larger diameter than the first turning or direction-changing bar, the web of material conducted around the turning or direction-changing bar and the register roller can be drawn off crossing the turning or direction-changing bar without additional direction-changing elements being required for this.

A second turning bar is required for a turning bar arrangement whose delivery direction is parallel with the feed direction of the web, and the web of material can usefully be looped in sequence around the first turning bar, the register roller and the second turning bar.

If at least one of the two turning bars can be changed from an orientation wherein it is parallel in respect to another turning bar, into an orthogonal orientation, this permits the selective operation of the turning bar arrangement in parallel, or in non-parallel feed and delivery directions.

A rapid and exact change of the orientation of the changeable turning bar can be achieved if the turning bar can be rotated about an axis which intersects the turning bar at a distance from one of its longitudinal ends, and if a marking is applied on this linear end, which marking can be made to coincide in the parallel or orthogonal orientation with respectively one of two complementary markings on a support of the turning bar. Thus, when changing the turning bar over, it is sufficient to check the coincidence of the markings in order to be assured that the angles of the turning bars are set exactly.

The exact setting of the turning bar is additionally simplified if the markings have a three-dimensional shape and can be brought into interlocking contact. With a construction of this type, the engagement of the markings already assures an exact orientation of the turning bar, without it being necessary for an operator to elaborately check the orientation.

BRIEF DESCRIPTION OF THE DRAWINGS

Preferred embodiments of the present invention are represented in the drawings and will be described in greater detail in what follows.

Shown are in.

Figure 1:
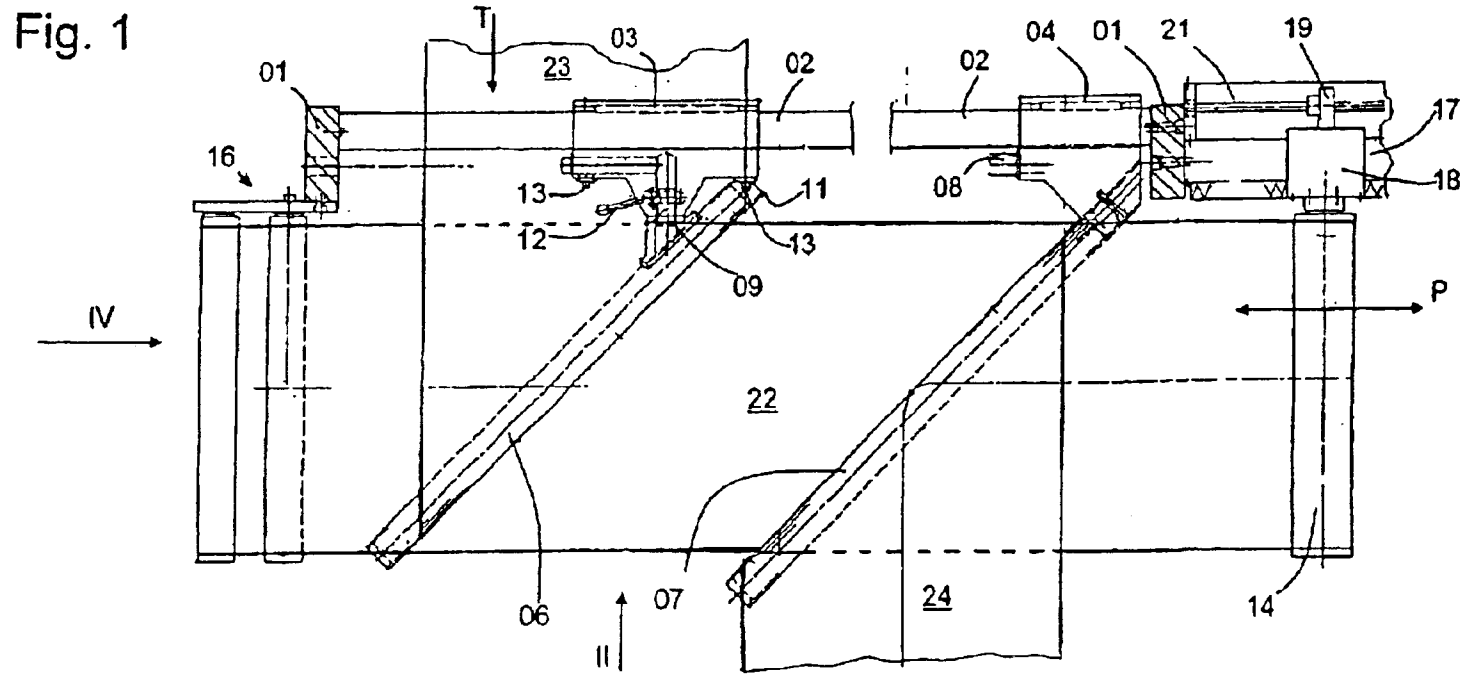
FIG. 1, a schematic top plan view of a turning bar arrangement in accordance with a first preferred embodiment of the present invention.

Referring initially to FIG. 1 there may be seen a top plan view of a first turning bar arrangement in accordance with a first preferred embodiment of the present invention. Two guide profiles or rails 02, on each of which a support 03, 04 for a turning bar 06, or 07, is displaceably and stopably arranged, extend, vertically stepped on different planes, between two lateral frames 01, which are connected with corresponding lateral frames of a longitudinal cutting apparatus that is not specifically represented and which is located before, in the direction of web travel, the turning bar arrangement. The lateral frames 01 of the turning bar arrangement are approximately aligned with the lateral frames of printing units of an associated rotary printing press. Here, a first longitudinal end of a first one of these turning bars 07 is rigidly connected with its associated support 04. The support 03 for the second turning bar 06 is connected with a shaft 09, which can be rotated around a horizontal axis parallel with the plane of FIG. 1, wherein the axis crosses the second turning bar 06 at a distance from the longitudinal end 11 of the second turning bar 06, which longitudinal end 11 is facing the support 03. The shaft 09 can be secured in place with the aid of a clamping lever 12 that is attached to the support 03. The support 03 has two markings 13, which are embodied as protrusions and whose exact position on the support 03 can be adjusted in three spatial positions. On its longitudinal end 11, the second turning bar 06 has a complementary marking in the form of a recess, which is shaped in such a way that it permits an interlocking engagement with one of the markings 13. It is possible to assure, by a suitable adjustment of the positions of the markings 13, that the second turning bar 06, in its position represented in FIG. 1, is exactly parallel with the first turning bar 07 or, following the swiveling of the second turning bar 06 by 180° about the axis of the shaft 09 and the engagement of the other of the two markings 13, it is oriented exactly orthogonally in respect to the first turning bar 07.

Each of the turning bar supports 03, 04 have connectors 08 for the receipt of compressed air, which compressed air is then conducted through bores in the support 03 or 04, into the turning bar 06, or 07, and exits through bores, which are not specifically shown, on the circumferential surface of the turning bars 06, or 07, in order to form an air cushion between the turning bars 06, 07 and a web 22 of material which is looped around them.

A register roller 14 is mounted outside of the lateral frame 01 on the side of the turning bar arrangement adjacent the first turning bar 07, and a deflection roller arrangement 16 is mounted on the other lateral frame 01 outside of that frame 01 and on the side of the turning bar arrangement adjacent the second turning bar 06. The register roller 14 is mounted on a sliding block 18, which can be displaced along a sliding block rail 17. A threaded body 19, which is fixedly connected with the sliding block 18, is in engagement with a threaded rod 21, which can be rotatingly driven by a motor, that is not specifically represented, in order to displace the register roller 14 in the direction of the two-headed arrow P, as seen in FIG. 1. The register roller 14 is arranged outside of each plane determined by print units associated with the respective lateral frame, and outside of a space located between the planes.

Figure 2:
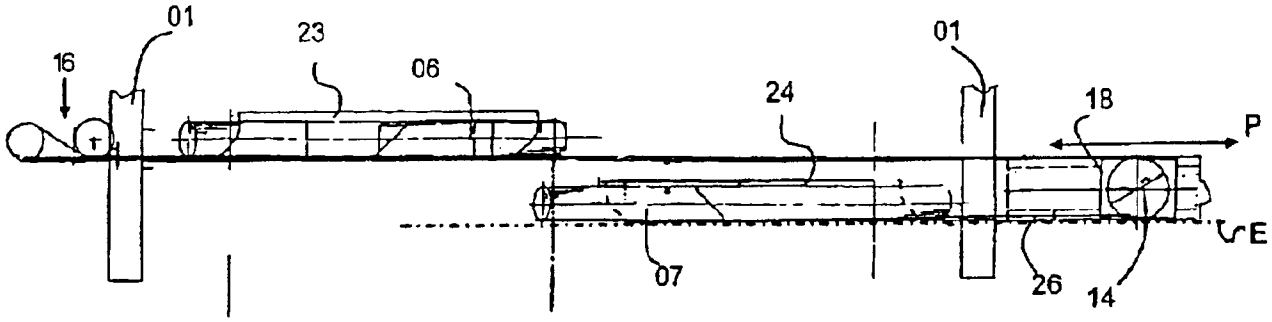
FIG. 2, a side elevation view of the turning bar arrangement of FIG. 1 taken in the direction of the arrow II in FIG. 1.

In FIG. 1, the web 22 of material is represented in a transparent fashion; only its edges are emphasized by heavy lines. The web 22 of material is sequentially looped around the second turning bar 06, the deflection roller arrangement 19, the register roller 14 and the first turning bar 07. It is assumed for the purposes of the present description that it is being moved in the direction of an arrow T; a movement in the opposite direction would of course also be possible. An arriving section 23 of the web 22 extends from the inlet of the turning bar arrangement as far as the second turning bar 06. As can be seen in FIG. 2 in particular, the web 22 of material is looped around the second turning bar 06 from top to bottom, reaches the deflection roller arrangement 16, is turned there by 180° and extends, at a short distance spaced from the underside of the second turning bar 06, transversely through the entire turning bar arrangement, to the top of the register roller 14. A section 26 of the web 22 of material extends from the underside of the register roller 14 to the underside of the first turning bar 07. This section 26 of the web 22 defines a plane E. The web 22 of material is looped around the first turning bar 07 from the bottom to the top, so that a departing section 24 of the web 22 of material finally leaves the turning bar arrangement from the top of the turning bar 07.

As can be easily seen by referring again to FIGS. 1 and 2, the arrangement of the deflection roller arrangement 16 and of the register roller 14, each laterally offset on the outer side of each respective one of the lateral frames 01 and outside of the movement area of the turning bars 06, 07 along the guide profiles or rails 02, makes it possible to keep the structural height of the turning bar arrangement low. The diameter of the register roller 14 is greater than that of the first turning bar 07 so that both can be arranged on the same side of the plane E, which contributes to a further reduction of the structural height. Since the register roller 14, as well as the first turning bar 07 are located above the plane E, which is defined by the section 26 of the web 22 of material extending between the register roller 14 and the first turning bar 07, the height difference between the incoming and outgoing sections 23, 24, respectively, of the web 22 can be kept still smaller than would correspond to the structural height of the turning bar arrangement.

Figure 3:
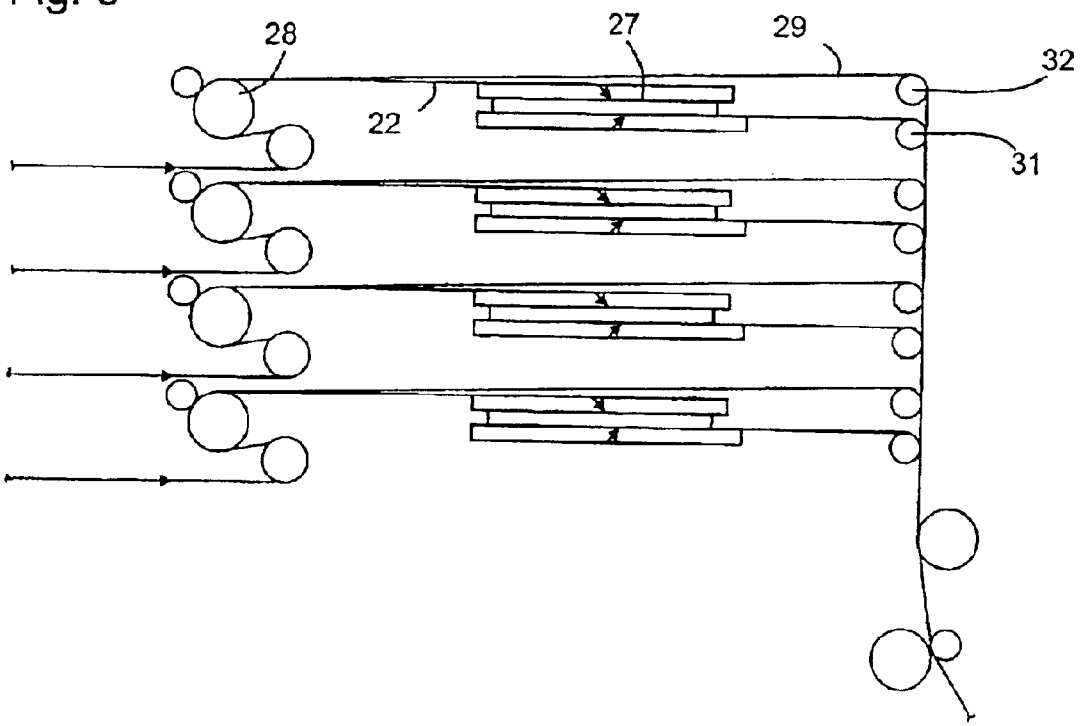
FIG. 3, a schematic side elevation view showing a stack of turning bar arrangements for placing a plurality of webs of material on top of each other.

FIG. 3 shows, in a very schematic manner, a stack, in which a plurality of turning bar arrangements 27, each of the type depicted in FIGS. 1 and 2, are arranged on top of each other The stack shown in FIG. 3 is viewed from the direction of the arrow IV shown in FIG. 1. The stack depicted in FIG. 3 comprises four turning bar arrangements 27 placed on top of each other, but their number can also be greater or lesser. A tensioning roller arrangement 28, for use in keeping two webs 22, 29 of material stretched, which two webs 22, 29 of material are fed parallel to each other from a cutting device that is not specifically represented, is assigned to each turning bar arrangement 27. The first web 22 of material is conducted through the turning bar arrangement 27 to a first deflecting roller 31, the second web 29 of material moves from the tensioning roller arrangement 28 directly to a second deflecting roller 32. The initial lateral offset between the first and second webs 22, 29 of material is changed by the turning bar arrangement 27, so that the two webs 22, 29 can be conducted to a folding apparatus that is not specifically represented for folding and cutting with their side or lateral edges overlapping exactly and also in phase with each other. This is accomplished by a suitable setting of the position of the register roller 14 of each turning bar arrangement 27 through the use of the sliding block 18.

Figure 4:
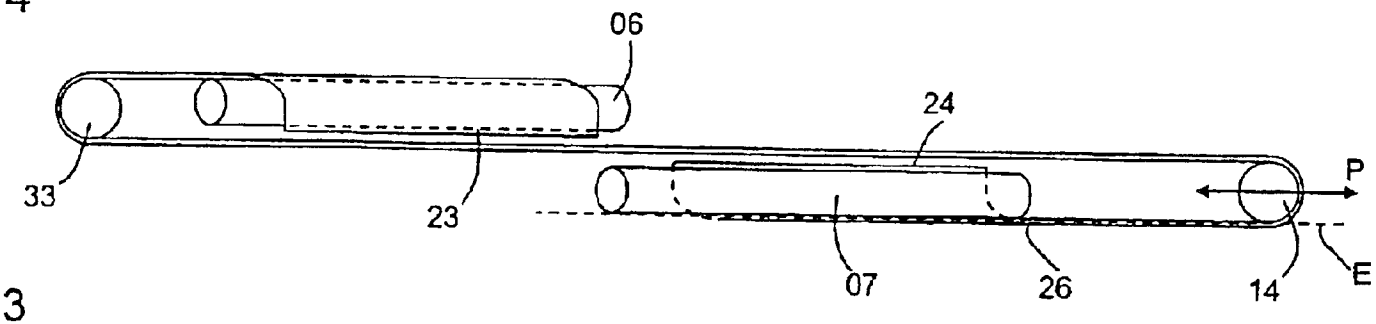
FIG. 4, a schematic side elevation view of a second preferred embodiment of the turning bar arrangement of the present invention and viewed from the same perspective as in FIG. 2; and in FIG. 5, a schematic side elevation view of a third preferred embodiment of the turning bar arrangement of the present invention.

FIG. 4 shows a second preferred embodiment of the turning bar arrangement viewed from the same direction as in FIG. 2. With the embodiment of FIG. 4, the incoming section 23 of the web 22 of material is conducted to the underside of the second turning bar 06, is looped around it from the bottom to the top, then turns from top to bottom around a deflection roller 33, which replaces the deflection roller arrangement 16 in FIG. 2, reaches the register, roller 14, which can be displaced in the direction of the arrow P, and from there runs in a manner as described in connection with FIG. 2. With this second preferred embodiment the height difference between the incoming and outgoing sections 23, and 24, of the material web 22 is minimal.

Figure 5:
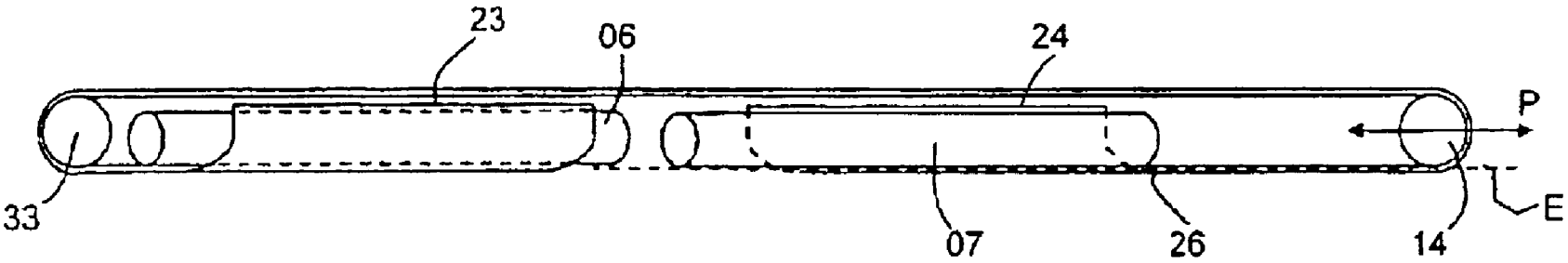

FIG. 5 shows a side elevation view of a third preferred embodiment of the turning bar arrangement of the present invention from a direction analogous to that of FIGS. 2 and 4. As was the situation with the second embodiment of FIG. 4, elements corresponding to elements of the first embodiment and previously described in connection with FIGS. 1 and 2, are provided with the same reference symbols and will not be described again. The structural height of the turning bar arrangement in this third embodiment is further reduced because both turning bars 06, 07 are arranged in a mutual plane E. The incoming and outgoing sections 23, 24 of the web 22 are located on the same level. The turning bar supports 03, 04, which are not visible in FIG. 5, are both mounted on a single guide profile or rail 02. With the two previously described preferred embodiments, the two turning bars 06, 07 could be moved as close to each other as desired, and could even be displaced above each other. This is not possible with the preferred embodiment of FIG. 5. However, no substantial limitation in the usefulness of the two turning bars 06, 07 is associated with this, because, in most cases, the webs 22, 29 of material, which are placed on top of each other with the aid of the turning bar arrangement 27, are partial webs that have been obtained from a uniform web by longitudinal cutting of the web, and which, so that they can be placed on top of each other, must be displaced by at least their own width. The distance between the turning bars 06, 07 needed for this partial web displacement can also be easily set with this third preferred embodiment. In order to be able to use the embodiment of FIG. 5 for the parallel displacement of a partial web selectively in opposite directions, it is sufficient that both turning bars 06, 07 can be changed over as described in FIG. 1 in connection with the second turning bar 06, so that the turning bar arrangement can be changed into its mirror reversed configuration.

All of the turning bars 06, 07, deflection roller arrangements 16, deflection rollers 33 and the register rollers 14 are preferably provided as cantilevered arms, i.e. only one end is supported as is shown in FIG. 1.

While preferred embodiments of a turning bar arrangement and a method for redirecting a web of material in accordance with the present invention have been set forth fully and completely hereinabove, it will be apparent to one of skill in the art that various changes in, for example the type of printing press used to print the webs, the type of longitudinal web slitting device and the like could be made without departing from the true spirit and scope of the present invention which is accordingly to be limited only by the following claims.

What is claimed is:

1. A turning bar arrangement adapted for changing a direction of travel of a material web, said turning bar arrangement comprising:

a first turning bar, said first turning bar being supported at only a first end and at an angle with respect to a direction of travel of a material web;

a register roller, said register roller being supported at only a first end for rotation about an axis of rotation parallel to said direction of travel of said material web;

a first plane defined by said material web in a path of travel extending between said register roller and said first turning bar, said first turning bar and said register roller being non-overlapping with respect to each other, when viewed in a plane perpendicular to said first plane; and means supporting said first end of said register roller for movement along said path of travel whereby registration of said material web is changed in response to said movement of said register roller.

2. The turning bar arrangement of claim 1 wherein said first turning bar and said register roller are both on the same side of said first plane.

3. The turning bar arrangement of claim 1 wherein said first turning bar has a first diameter and said register roller has a second diameter, said second diameter being greater than said first diameter.

4. The turning bar arrangement of claim 1 further including a second turning bar and wherein the web of material can be looped sequentially around said first turning bar, said register roller and said second turning bar.

5. The turning bar arrangement of claim 4 wherein at least one of said first and second turning bars is shiftable with respect to one of the other of said first and second turning bars between a first position where said first and second turning bars are parallel and a second position where said first and second turning bars are orthogonal.

6. The turning bar arrangement of claim 5 further including a turning bar support for said shiftable turning bar, said turning bar support having first and second complementary turning bar support markings, said shiftable turning bar being supported by said turning bar support for rotation about an axis intersecting said shiftable turning bar intermediate its ends, and a turning bar marking on an end of said shiftable turning bar, said turning bar marking being alignable with selectively one of said first and second complementary turning bar support markings when said shiftable turning bar is in selectively one of said parallel and orthogonal positions.

7. The turning bar arrangement of claim 6 wherein said first and second complementary turning bar support markings and said turning bar marking each have a three dimensional shape and selectively one of said first and second complementary turning bar support markings and said turning bar marking are interlockingly engageable when said turning bar is selectively in one of said parallel and orthogonal positions.

8. The turning bar arrangement of claim 4 further including at least one deflection roller arrangement around which the web of material can be looped, said at least one deflection roller arrangement being located, along a path of travel of the material web, intermediate said register roller and said second turning bar, said first and said second turning bars and said deflection roller arrangement being non-overlapping with respect to each other, when viewed in a plane perpendicular to said first plane.

9. A turning bar arrangement adapted for changing a direction of travel of a material web, said turning bar arrangement comprising:

a first turning bar about which a material web can be looped;

a register roller about which said material web can be looped;

a first plane defined by said material web in a path of travel between said register roller and said first turning bar;

lateral frames supporting said register roller, said register roller being positioned outside of said lateral frames when viewed in a plane perpendicular to said first plane, said register roller having an axis of rotation parallel with the direction of travel of a material web; and means supporting said register roller for movement along said path of travel whereby registration of said material web is changed in response to said movement of said register roller.

10. The turning bar arrangement of claim 9 further including a second turning bar and wherein the web of material can be looped sequentially around said first turning bar, said register roller and said second turning bar.

11. The turning bar arrangement of claim 10 wherein at least one of said first and second turning bars is shiftable with respect to one of the other of said first and second turning bars between a first position where said first and second turning bars are parallel and a second position where said first and second turning bars are orthogonal.

12. The turning bar arrangement of claim 11 further including a turning bar support for said shiftable turning bar, said turning bar support having first and second complementary turning bar support markings, said shiftable turning bar being supported by said turning bar support for rotation about an axis intersecting said shiftable turning bar intermediate its ends, and a turning bar marking on an end of said shiftable turning bar, said turning bar marking being alignable with selectively one of said first and second complementary turning bar support markings when said shiftable turning bar is in selectively one of said parallel and orthogonal positions.

13. The turning bar arrangement of claim 12 wherein said first and second complementary turning bar support markings and said turning bar marking each have a three dimensional shape and selectively one of said first and second complementary turning bar support markings and said turning bar marking are interlockingly engageable when said turning bar is selectively in one of said parallel and orthogonal positions.

14. The turning bar arrangement of claim 10 further including at least one deflection roller arrangement around which the web of material can be looped, said at least one deflection roller arrangement being located, along a path of travel of the material web, intermediate between said register roller and said second turning bar, said first and said second turning bars and said deflection roller arrangement being non-overlapping with respect to each other, when viewed in a plane perpendicular to said first plane.

15. A method for changing a direction of travel of a web of material including:

providing a first turning bar and directing said web of material arriving in a conveying direction to a top of said first turning bar;

using said first turning bar and redirecting said web of material transversely to said conveying direction;

providing a deflection roller and conducting said web of material from an underside of said first turning bar to an underside of said deflection roller;

using said deflection roller and reversing said web of material 180° from said conveying direction by conducting said web of material from a top of said deflection roller;

providing a register roller and directing said web of material from said top of said deflection roller to a top of said register roller;

using said register roller and reversing said web of material by 180°;

providing a second turning bar and directing said web from an underside of said register roller to an underside of said second turning bar;

redirecting said material web from a top of said second turning bar in said conveying direction supporting said register roller at only a first end for movement transversely to said conveying direction; and changing a registration of said web of material in response to movement of said resister roller.

16. The method of claim 15 further including conducting the web of material extending transversely in respect to the conveying direction above said first turning bar and said second turning bar.

17. The method of claim 15 further including conducting the web of material extending transversely in respect to the conveying direction between said first turning bar and said second turning bar.

18. A method for changing a direction of travel of a web of material including:

providing a first turning bar and directing said web of material arriving in a conveying direction to a top of said first turning bar;

using said first turning bar and redirecting said web of material transversely to said conveying direction;

providing a deflection roller and conducting said web of material from an underside of said first turning bar to a top of said deflection roller;

using said deflection roller and reversing said web of material 180° from said conveying direction by conducting said web of material from an underside of said deflection roller;

providing a register roller and directing said web of material from said underside of said deflection roller to a top of said register roller;

using said register roller and reversing said web of material by 180°;

providing a second turning bar and directing said web from an underside of said register roller to an underside of said second turning bar;

redirecting said material web from a top of said second turning bar in said conveying direction; and supporting said register roller at only a first end for movement transversely to said conveying direction; and changing a registration of said web of material in response to movement of said register roller.

19. The method of claim 18 further including conducting the web of material extending transversely in respect to the conveying direction between said first turning bar and said second turning bar.

* * * * *